US006779279B2

(12) United States Patent
Lee et al.

(10) Patent No.: US 6,779,279 B2
(45) Date of Patent: Aug. 24, 2004

(54) DRYER HAVING A FILTER SENSING SYSTEM

(75) Inventors: Soon-Jo Lee, Gyeongsangnam-Do (KR); Hae Deog Jeong, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/190,613

(22) Filed: Jul. 9, 2002

(65) Prior Publication Data

US 2004/0006886 A1 Jan. 15, 2004

(51) Int. Cl.[7] ..... F26B 21/06

(52) U.S. Cl. ..... 34/82; 34/595; 34/607; 34/235

(58) Field of Search ..... 34/549, 550, 552, 34/553, 554, 79, 82, 595, 604, 606, 607, 135, 136, 137, 235

(56) References Cited

U.S. PATENT DOCUMENTS

| | | | | | |
|---|---|---|---|---|---|
| 4,206,552 | A | * | 6/1980 | Pomerantz et al. | 34/445 |
| 4,700,492 | A | | 10/1987 | Werner et al. | |
| 5,321,897 | A | * | 6/1994 | Holst et al. | 34/260 |
| 5,367,787 | A | * | 11/1994 | Ikeda et al. | 34/549 |
| 5,443,541 | A | * | 8/1995 | St. Louis | 34/486 |
| 5,444,924 | A | * | 8/1995 | Joslin et al. | 34/486 |
| 5,544,428 | A | * | 8/1996 | Kuroda et al. | 34/493 |
| 5,564,831 | A | * | 10/1996 | Bashark | 374/141 |
| 5,673,497 | A | * | 10/1997 | St. Louis | 34/486 |
| 5,706,588 | A | | 1/1998 | Dausch et al. | |
| 6,088,932 | A | | 7/2000 | Adamski et al. | |
| 6,158,148 | A | * | 12/2000 | Krausch | 34/497 |
| 6,666,020 | B2 | * | 12/2003 | Tonetti et al. | 60/286 |

FOREIGN PATENT DOCUMENTS

| | | | | |
|---|---|---|---|---|
| EP | 0 512 940 A1 | * | 11/1992 | D06F/58/28 |
| JP | 2-305599 A | * | 12/1990 | D06F/58/28 |
| JP | 4-256799 A | * | 9/1992 | D06F/58/28 |
| JP | 4-285599 A | * | 10/1992 | D06F/58/28 |
| JP | 6-31100 A | * | 2/1994 | D06F/58/28 |
| JP | 6-154488 A | * | 6/1994 | D06F/58/28 |
| JP | 6-190196 A | * | 7/1994 | D06F/58/28 |

* cited by examiner

*Primary Examiner*—Henry Bennett
*Assistant Examiner*—Andrea M. Ragonese
(74) *Attorney, Agent, or Firm*—McKenna Long & Aldridge LLP

(57) ABSTRACT

A dryer having a filter sensing system that warns a user that a filter requires servicing is provided. The dryer includes a drum that retains laundry. Hot air is drawn through the drum (for drying) and out an exhaust casing having a filter for removing lint and other particles. The temperature difference of the air in front of the filter (on the drum side) and behind the filter is determined using temperature sensors. When that temperature difference exceeds a predetermined threshold, a control unit causes a notice unit to produce a warning signal that informs a user that filter service is required.

9 Claims, 3 Drawing Sheets

DRYER HAVING A FILTER SENSING SYSTEM

BACKGROUND OF THE INVENTION

1. Field of the Invention

The present invention relates to dryers. More particularly, the present invention relates to dryers that automatically sense clogged filters and that notify users when filter service is required.

2. Background of the Related Art

There are two basic types of dryers. Exhaust dryers dry using external air, while dehumidification dryers dry by dehumidifying internally circulated air.

FIG. 1 illustrates a typical exhaust dryer. As shown, the dryer includes a drum 20 inside a case 10. A driving unit 30 rotates the drum 20 so as to turn any laundry or other wet items within the drum. A heater 25 is located in a suction casing 22 behind the drum 20. A fan 35 inside an exhaust casing 27 in front of and below the drum 20 draws air into the suction casing 22, past the heater 25 (which heats the air), through the drum 20, and through the exhaust casing 27.

Still referring to FIG. 1, the dryer has a front opening 11. A door 15 can be opened to enable entry and removal of items into and out of the drum. When closed, the door 15 renders the drum 20 airtight. The driving unit 30 includes a double-shaft motor 31 that simultaneously turns the fan 35 and the drum 20. A pulley 32 on the motor 31, together with a belt 33 around the pulley 32 and the drum 20, transfer rotational forces to the drum 20.

As noted, a suction port 20*a* behind the drum 20 passes heated air into the drum 20. An exhaust port 27*a* in the exhaust casing 27 passes exhausted air from the drum 20 along and out an exhaust path 27*b*. As shown, a filter 40 is located in the exhaust path 27*b*. That filter collects (traps) particles, such as lint, that are produced during drying.

While generally successful, eventually the collected (trapped) particles build up such that the filter 40 becomes clogged. This significantly reduces airflow, and consequently drying efficiency. Therefore, periodically the filter 40 should be exchanged, cleaned, or otherwise serviced. Otherwise, drying efficiency will continue to drop, causing increased power consumption, longer drying times, and a dissatisfied user.

Unfortunately, the state of the filter (whether it is or is not clogged) is not obvious to a user. One reason for this is that the dryer provides no indication that filter service is required. Therefore, a clogged filter sensor would be beneficial. Even more beneficial would be a dryer that senses a clogged filter and that notifies a user that filter service, such as replacement or cleaning, is required.

SUMMARY OF THE INVENTION

Accordingly, the present invention is directed to a dryer having a filter sensing system that substantially obviates one or more problems due to limitations and disadvantages of the related art.

An advantage of the present invention is a dryer having a filter sensing system that informs a user of a clogged filter. Beneficially, the filter sensing system senses a clogged filter when a predetermined temperature difference occurs between the air entering the filter and the air exiting the filter. Also beneficially, the filter sensing system notifies a user to service (possibly replace) the filter in time to avoid problems caused by a clogged filter.

Additional advantages, objects, and features of the invention will be set forth in the description which follows and/or will become apparent to those having ordinary skill in the art upon examination of the following, and/or may be learned from practice of the invention. The objectives and other advantages of the invention may be realized and attained by the structure particularly pointed out in the written description and the claims, as well as the appended drawings.

To achieve these advantages and in accordance with the purpose of the invention, as embodied and broadly described herein, a filter sensing system according to the present invention includes a filter inside a dryer exhaust casing for collecting particles in exhaust air. An inlet temperature sensor senses the temperature of the air that enters the filter, and an outlet temperature sensor senses the temperature of the air that exits the filter. A control unit uses the sensed temperature difference to determine when filter service is required.

Preferably, one of the temperature sensors is installed at an exhaust port between the drum and the filter inlet, while another temperature sensor is located behind the filter (in the air stream that leaves the filter).

Suitable temperature sensors include thermistors. Such thermistors are beneficially used as elements of a Wheatstone bridge circuit. In practice, the filter sensing system further includes a notice unit that informs a user when filter service is beneficial. Preferably, the control unit produces an alarm signal that actuates the notice unit when the temperature difference sensed by the temperature sensors exceeds a predetermined value. Suitable notice units include audio alarms and visual signals.

In another aspect of the present invention, a dryer includes an exhaust casing that receives air from a drum. A filter in the exhaust casing filters particles in the air from the drum. Temperature sensors are located in front of and behind the filter. The temperature sensors sense the temperature of the air that enters the filter and the temperature of the air that leaves the filter. A control unit receives temperature information from the temperature sensors. Based on that information, the control unit determines a state of the filter and causes a notice unit to signal that state.

Beneficially, the temperature sensors are thermistors. Preferably, the thermistors are electrically configured as elements of a Wheatstone bridge circuit. Preferably, the control unit actuates the notice unit when the temperature difference between the air that enters the filter and the air the leaves the filter exceeds a predetermined value. Suitable notice units include audio alarms and/or visual signals.

In a further aspect of the present invention, a dryer having a filter sensing system includes a rotating drum in a case, an exhaust casing that receives air from the drum, and a filter in the exhaust casing through which the received air passes. Additionally, temperature sensors in front of and behind the filter sense air temperature. Based on the output of the temperature sensors, a control unit determines a state of the filter, and produces an alarm signal that causes a notice unit to inform the user about the determined state of the filter.

Preferably, the temperature sensors are thermistors. In one embodiment, the control unit causes the notice unit to signal the state of the filter when the temperature difference sensed by the thermistors exceeds a predetermined value.

More preferably, at least one of the temperature sensors is installed in an exhaust port between the drum and the exhaust casing and in front of the filter. Additionally, at least one of the temperature sensors is inside the exhaust casing behind the filter.

Beneficially, the dryer includes a display unit that displays information regarding drying controls. In that case, the notice unit can include a portion of the display unit.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE ILLUSTRATED EMBODIMENTS

Reference will now be made in detail to the illustrated embodiments of the present invention, examples of which are shown in the accompanying drawings.

Figure 1:
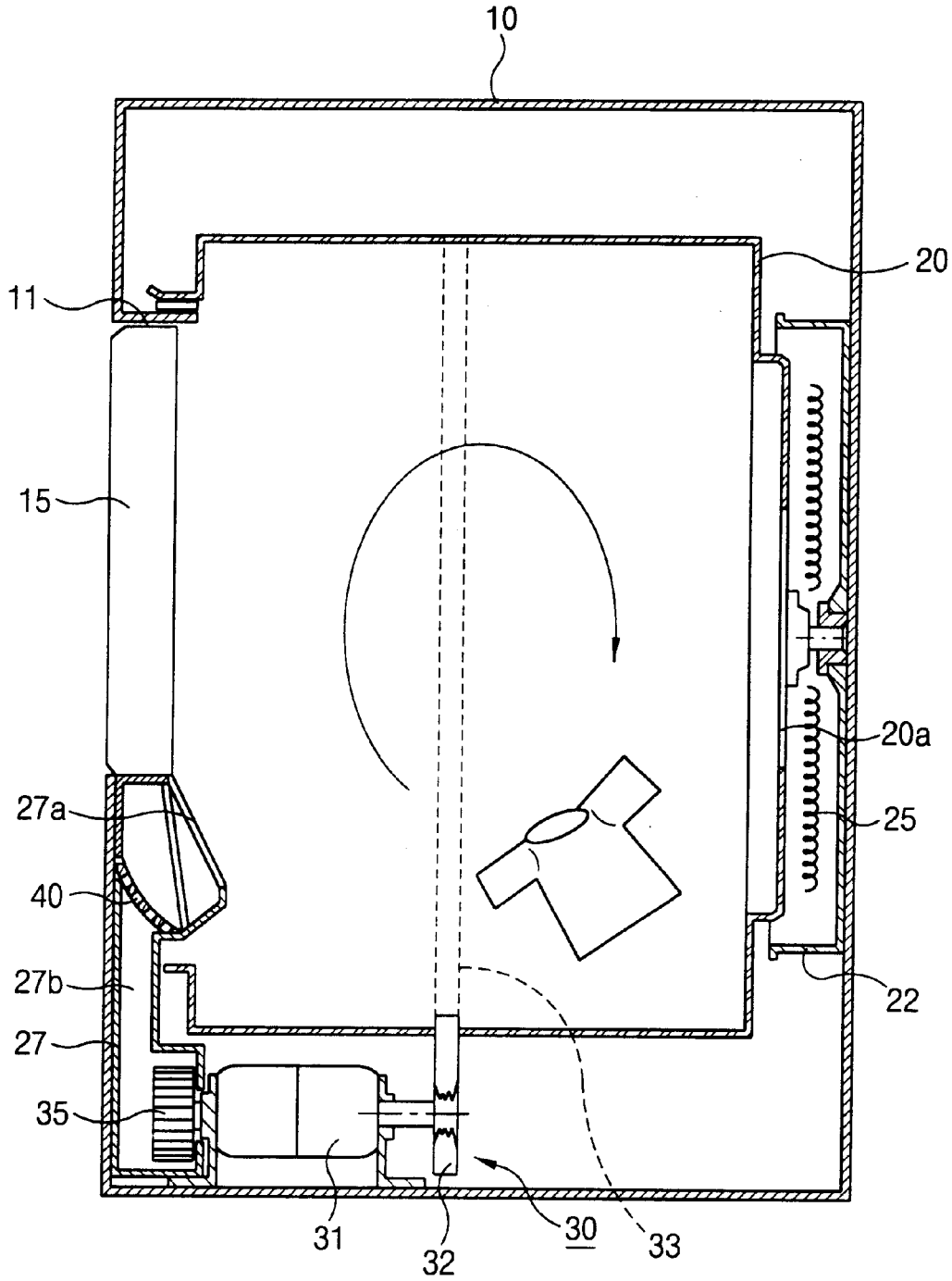
FIG. 1 CONVENTIONAL ART
FIG. 1 illustrates a schematic, cross-sectional view of an exhaust type dryer according to a related art.
Figure 2:
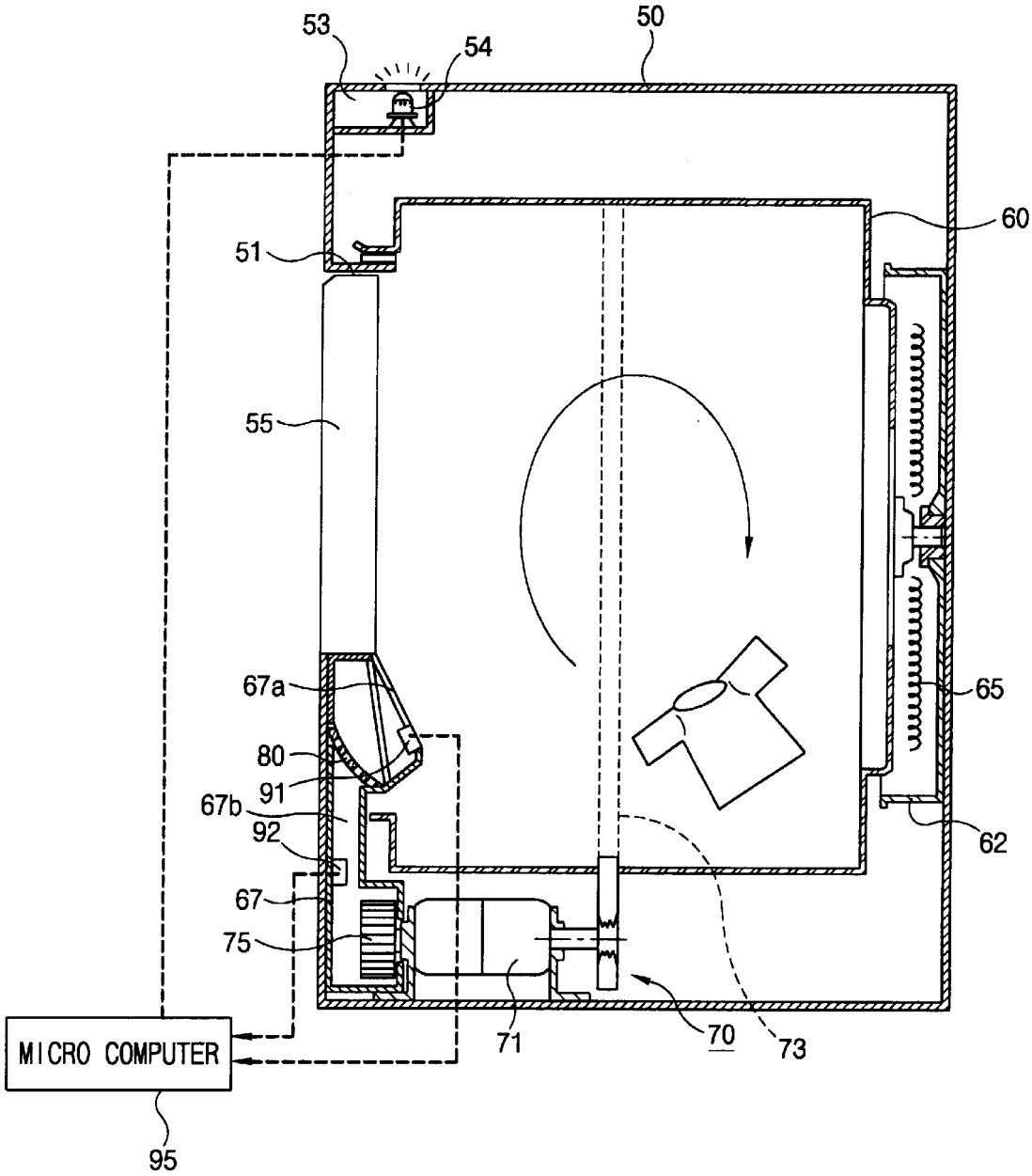
FIG. 2 illustrates a schematic, cross-sectional view of a dryer having a filter sensing system according to the present invention.
Figure 3:
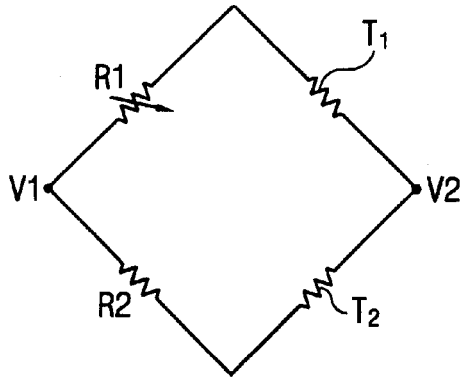
FIG. 3 illustrates a circuit of a filter sensing system according to the present invention.

FIG. 2 illustrates a schematic cross-sectional view of a dryer having a filter sensing system according to the principles of the present invention; FIG. 3 illustrates a filter sensing system circuit according to the principles of the present invention; and FIG. 4 illustrates a graph of time-air temperature variations in a dryer according to the principles of the present invention.

Referring now to FIG. 2, the dryer includes a rotating drum 60 for retaining a wet item such as laundry. The drum 60 is inside a case 50. A driving unit 70, which includes a motor 71 and a belt 73, rotates the drum 60. The dryer further includes a heater 65 in a suction casing 62 that is behind the drum 60. The motor 71 rotates a fan 75 in an exhaust casing 67. Additionally, a front opening 51 can be selectively opened and closed by a door 55. The door 55 enables a user to put laundry into and to remove laundry from the drum 60. When closed, the door 55 beneficially seals the drum 60 so as to make the drum 60 airtight.

Still referring to FIG. 2, the exhaust casing 67, which is located in front of and below the door 55, includes an exhaust port 67*a* that leads to an exhaust path 67*b*. A filter 80 is in the exhaust path 67*b*. The dryer further includes a temperature sensor 91 in front of the filter 80 (that is, between the filter and the drum 60) and a temperature sensor 92 behind the filter 80 (that is, between the filter 80 and the fan 75). The temperature sensor 91 senses the temperature of the air that enters the filter 80, while the temperature sensor 92 senses the temperature of the air that exits the filter 80. In practice, the temperature sensor 91 is beneficially located adjacent the exhaust port 67*a*.

Figure 4:
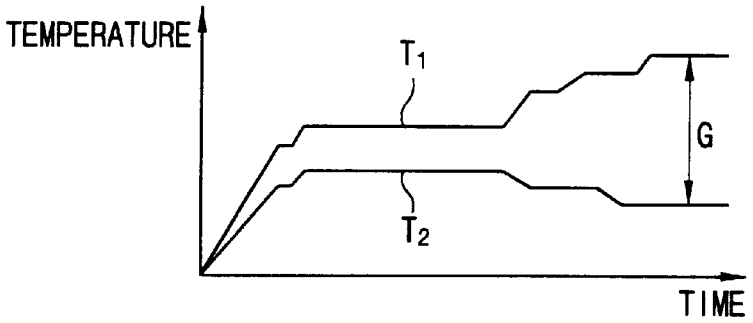
FIG. 4 illustrates a graph of time-air temperature variations of air that enters a filter and air that exits a filter in a dryer that is in accord with the principles of the present invention.

Referring now to FIGS. 2–4, the temperature sensors 91 and 92 are preferably thermistors T1 and T2. As such, the electrical resistance of the temperature sensors 91 and 92 vary in accordance with temperature. Referring now specifically to FIG. 3, beneficially the temperature sensors 91 and 92 (thermistors T1 and T2) are used as legs of a Wheatstone bridge. The other legs include a variable resistor R1 and a fixed resistor R2. Once the Wheatstone bridge is compensated for differences between R1–R2 and T1–T2, any temperature difference between the temperature sensors 91 and 92 (thermistors T1 and T2) produces a voltage between nodes V1 and V2.

Any voltage difference between V1 and V2 (see FIG. 3) is applied to a microcomputer 95 (see FIG. 2) that acts as a control unit. Based on the applied voltage difference the microcomputer 95 determines whether the filter 80 is clogged. FIG. 4 provides a graph of time verses air temperature curves that illustrate air temperature differences across the filter 80. As time passes the filter 80 collects particles. This reduces airflow through the filter 80, which results in a greater temperature difference between the air that enters the filter and the air that leaves the filter. Eventually, the temperature difference reaches a predetermined value of G, which represents a clogged filter 80.

If the filter 80 is determined to be clogged, the microcomputer 95 (the control unit) produces an alarm signal that is applied to a display unit 53 (which acts as a notice unit). For example, the display unit 53 included a lamp 54 that emits red light or that causes a message that is interpreted by a user (such as a flashing message) in response to an alarm signal. Alternatively, the notice unit could include an audio alarm. In any event, the display unit (or notice unit) beneficially notifies a user that the filter 80 requires servicing. For example, the user might be informed that the filter 80 needs cleaning, replacement, or other attention.

The operation of the dryer illustrated in FIG. 2 is as follows. Once the motor 71 is energized the drum 60 and the fan 75 rotate. The fan 75 draws air into the suction casing 62, past the heater 65, which heats the air, and into the drum 60. The hot air in the drum 60 causes any wet items in the drum 60 to dry. The air in the drum picks up moisture and particles, such as lint and fuzz. The moist, hot air and particles are drawn out of the drum 60, through the exhaust port 67*a*, and along the exhaust path 67*b* of the exhaust casing 67.

As the moist, hot air passes through the exhaust path 67*b* that air passes through the filter 80. There, particles in the air, such as lint and fuzz, are removed from the air and retained (collected) in the filter 80. In the process, a temperature difference results between the air that enters the filter 80 and the air the exits the filter 80. If the filter 80 is not clogged, that temperature difference is less than the predetermined value G. However, if the filter 80 is clogged, that temperature difference increases so as to reach or exceed G.

The temperature of the air that enters the filter 80 is sensed by an inlet temperature sensor 91 (thermistor T1), while the temperature of the air that leaves the filter 80 is sensed by an outlet temperature sensor 92 (thermistor T2). The temperature difference sensed by the inlet and outlet temperature sensors causes a potential difference between nodes V1 and V2 (reference FIG. 3). When the temperature difference exceeds the predetermined interval G (reference FIG. 4) the microcomputer 95 determines that the filter 80 is clogged. Then, the microcomputer 95 produces an alarm signal that causes the display unit 53 to produce a warning signal to a user that the filter 80 requires servicing. After the filter 80 is properly serviced, such as by replacement or cleaning, the temperature difference drops, which causes the potential difference between nodes V1 and V2 (reference FIG. 3) to drop below the predetermined interval G. The microcomputer 95 recognizes this and turns the alarm signal off.

Thus, a dryer according to the principles of the present invention includes a temperature sensing system that senses the temperature difference between air that enters and leaves a filter. That temperature difference is used to produce a signal that informs a user that the filter requires servicing. Suitable servicing can increase drying efficiency, which can decrease power consumption and can improve user satisfaction.

The forgoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A clothes dryer filter sensing system, comprising:

a filter inside a clothes dryer exhaust casing for removing particles from exhaust air;

an inlet temperature sensor for sensing the temperature of air entering the filter, the inlet temperature sensor being disposed within the clothes dryer exhaust casing;

an outlet temperature sensor for sensing the temperature of air exiting the filter; and a control unit operatively connected to the inlet and outlet temperature sensors, wherein the control unit determines whether the filter requires servicing based on a temperature difference between the inlet and outlet temperature sensors.

2. The clothes dryer filter sensing system of claim 1, wherein air enters the clothes dryer exhaust casing through an exhaust port, and wherein the inlet temperature sensor is adjacent the exhaust port.

3. The clothes dryer filter sensing system of claim 1, wherein the inlet and outlet temperature sensors are thermistors.

4. The clothes dryer filter sensing system of claim 3, wherein the inlet and outlet temperature sensors are used in a Wheatstone bridge circuit.

5. The clothes dryer filter sensing system of claim 1, further including a notice unit for informing a user that the filter requires service, wherein the notice unit is controlled by the control unit.

6. The clothes dryer filter sensing system of claim 5, wherein the control unit actuates the notice unit when the temperature difference between the inlet and outlet temperature sensors exceeds a predetermined value.

7. The clothes dryer filter sensing system of claim 1, further comprising a notice unit for informing a user about a state of the filter in response to a signal from the control unit.

8. The clothes dryer filter sensing system of claim 7, wherein the control unit actuates the notice unit when the temperature difference between the inlet and outlet temperature sensors exceeds a predetermined value.

9. The clothes dryer filter sensing system of claim 7, wherein the notice unit is selected from the group consisting of an audio alarm and a visual signal.

* * * * *